US007061440B2

(12) United States Patent
Choo et al.

(10) Patent No.: US 7,061,440 B2
(45) Date of Patent: Jun. 13, 2006

(54) ELECTRICALLY SMALL PLANAR ANTENNAS WITH INDUCTIVELY COUPLED FEED

(75) Inventors: Hosung Choo, Seoul (KR); Hao Ling, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 6 days.

(21) Appl. No.: 10/867,563

(22) Filed: Jun. 14, 2004

(65) Prior Publication Data

US 2005/0057409 A1 Mar. 17, 2005

Related U.S. Application Data

(60) Provisional application No. 60/477,974, filed on Jun. 12, 2003.

(51) Int. Cl.
*H01Q 21/00* (2006.01)

(52) U.S. Cl. ..... 343/728; 343/895

(58) Field of Classification Search ..... 343/741, 343/725, 728, 795, 895, 866
See application file for complete search history.

(56) References Cited

U.S. PATENT DOCUMENTS

| | | | | |
|---|---|---|---|---|
| 4,395,714 | A * | 7/1983 | Takeda et al. | 343/725 |
| 6,154,177 | A * | 11/2000 | Saito et al. | 343/702 |
| 6,173,897 | B1 * | 1/2001 | Halpern | 235/488 |
| 6,215,456 | B1 * | 4/2001 | Nakanishi | 343/895 |
| 6,753,820 | B1 * | 6/2004 | Koeberl et al. | 343/728 |
| 6,774,865 | B1 * | 8/2004 | Serra | 343/895 |
| 6,819,295 | B1 * | 11/2004 | Peng et al. | 343/728 |
| 6,867,709 | B1 * | 3/2005 | Povey et al. | 340/941 |
| 2003/0114118 | A1 * | 6/2003 | Fukushima et al. | 455/82 |

* cited by examiner

*Primary Examiner*—Tan Ho
(74) *Attorney, Agent, or Firm*—Antony P. Ng; Dillon & Yudell LLP

(57) ABSTRACT

Inductively coupled antennas and methods of designing the same are disclosed. Electrically small antennas having relatively high efficiency and relatively broad bandwidth may be formed by inductively coupling an antenna loop to at least one antenna winding. Such antennas may be substantially planar. Various operating characteristics of such antennas may be adjustable by and/or dependent upon the strength of the inductive coupling between an antenna winding and an antenna loop.

12 Claims, 7 Drawing Sheets

Configuration of the meander-winding antenna and the resulting bandwidth as a function of antenna size.

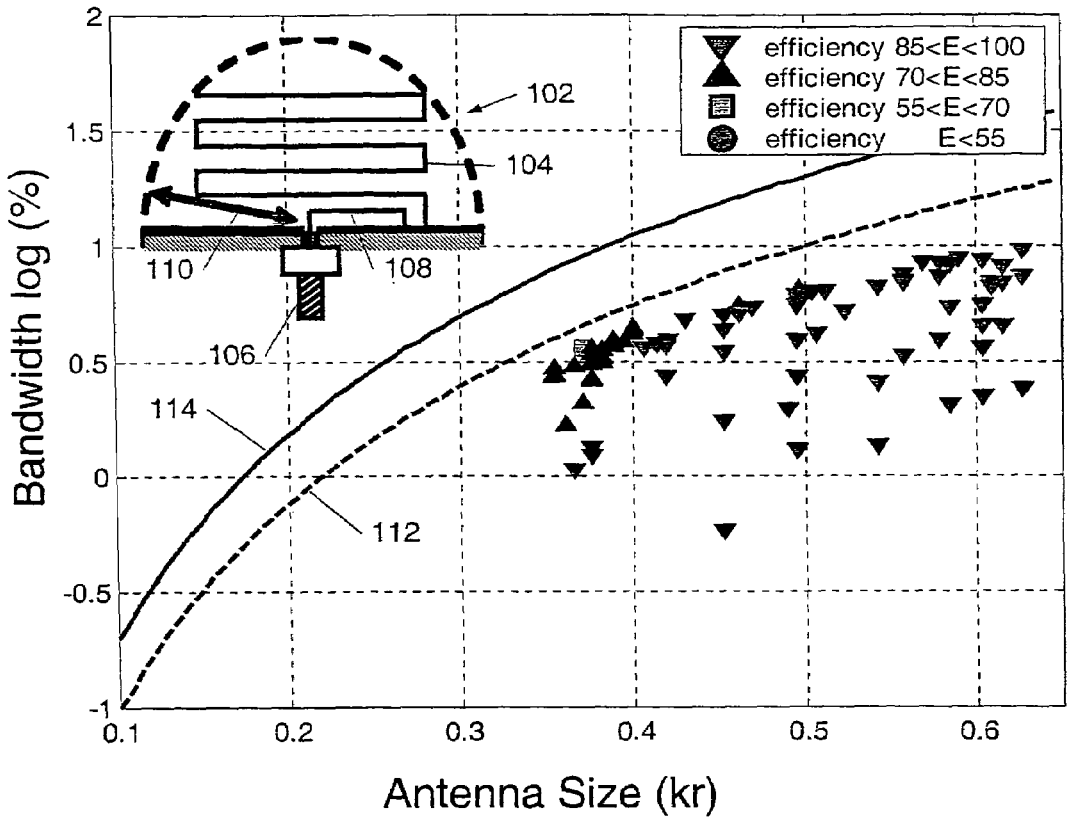
Fig. 1. Configuration of the meander-winding antenna and the resulting bandwidth as a function of antenna size.

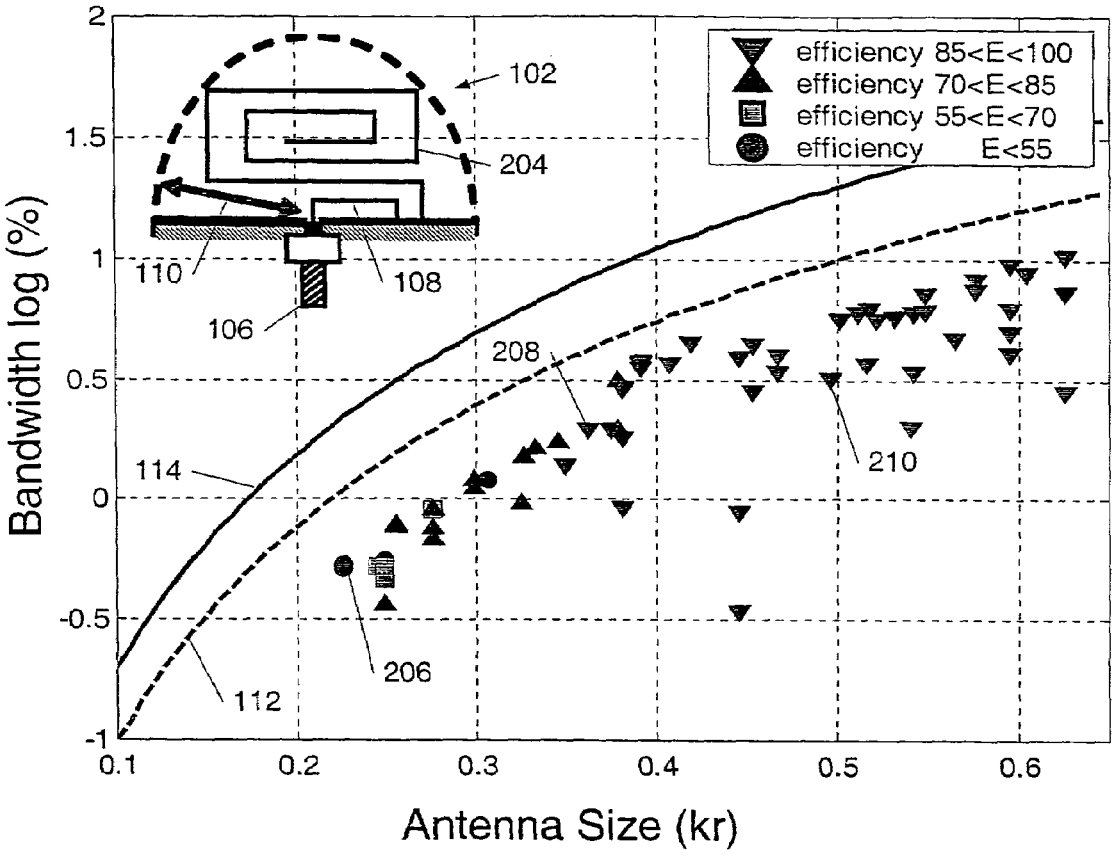
Fig. 2. Configuration of the spiral-winding antenna and the resulting bandwidth as a function of antenna size.

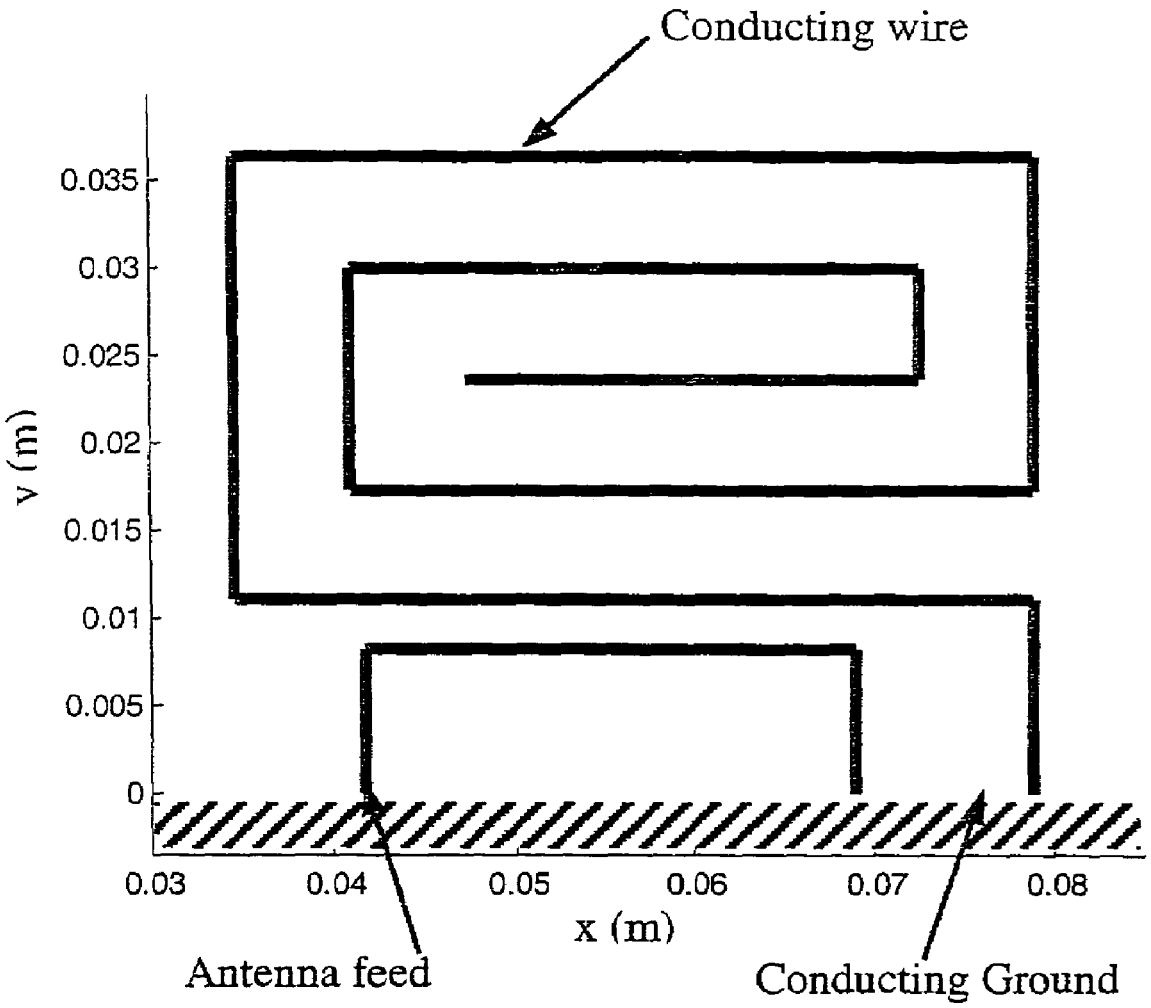
Fig. 3. Geometry of the inductively coupled monopole antenna B.

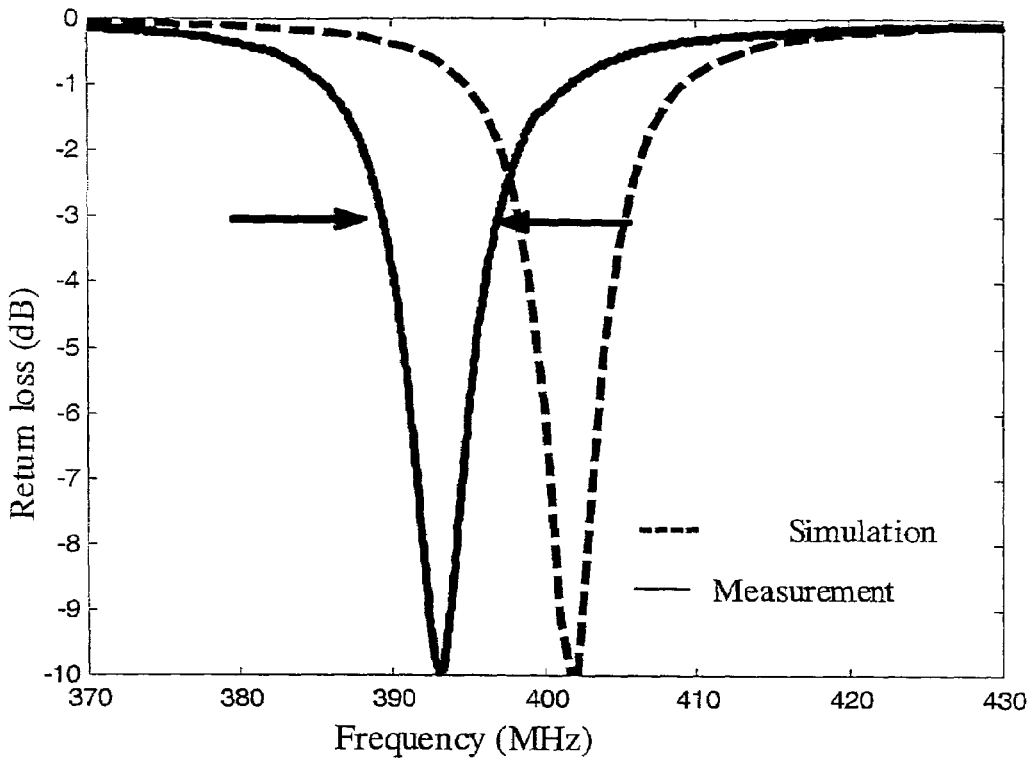
Fig. 4 Return Loss vs. frequency for antenna B.

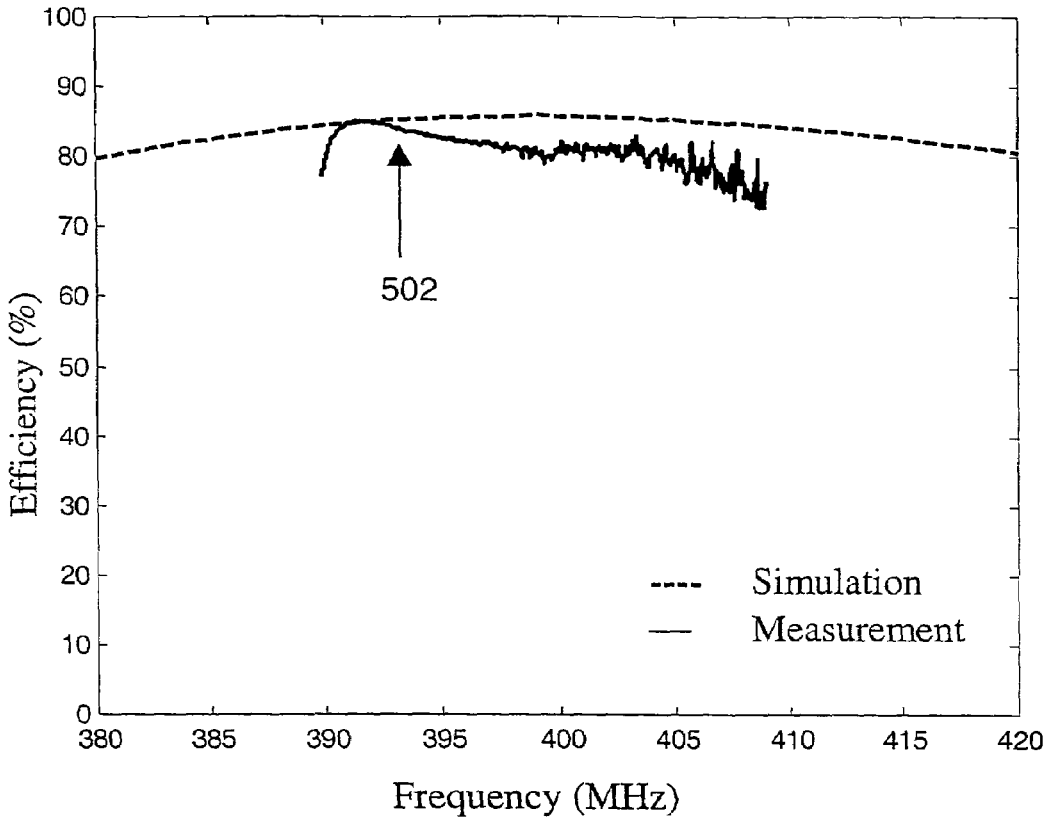
Fig. 5 Efficiency vs. frequency for antenna B.

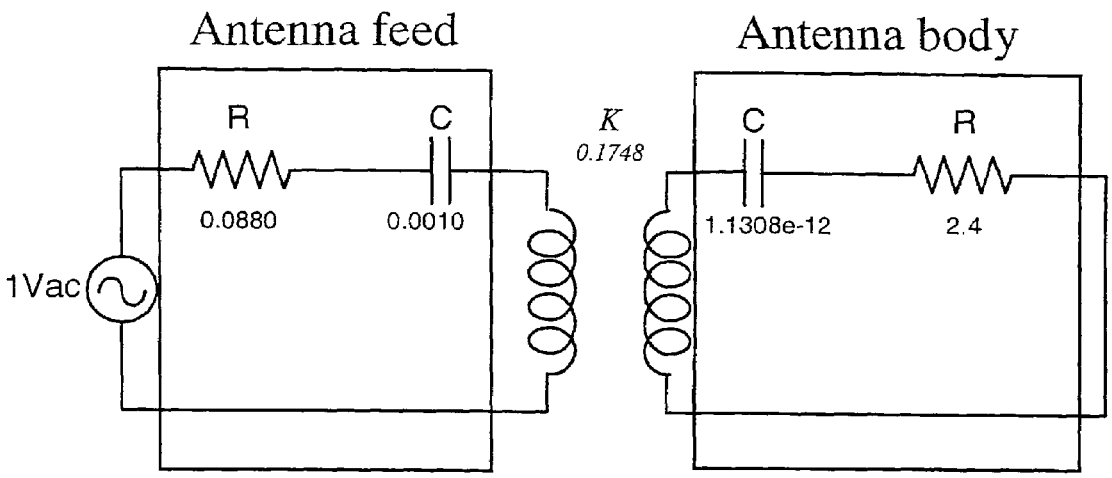
Fig. 6 Circuit model for the inductively coupled monopole antenna.

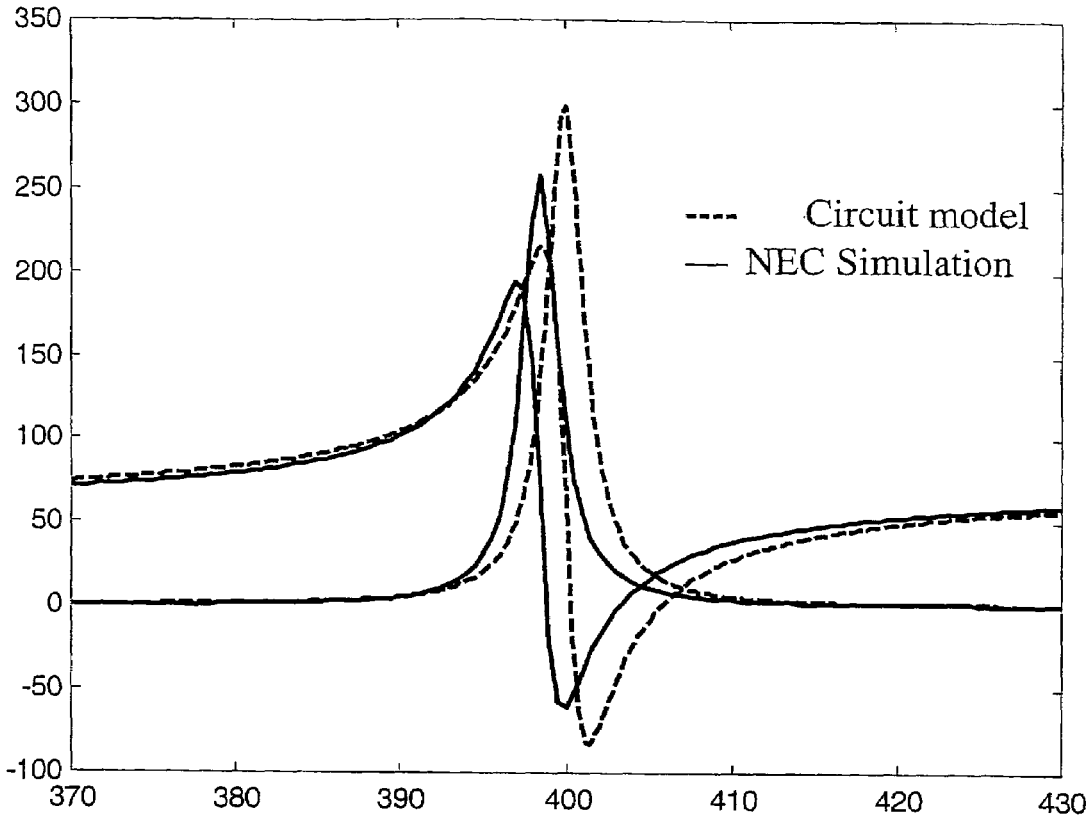
Fig. 7 Input impedance using circuit model (--) vs. NEC simulation (— )

ELECTRICALLY SMALL PLANAR ANTENNAS WITH INDUCTIVELY COUPLED FEED

PRIORITY CLAIM

This application claims priority to U.S. Provisional Patent Application No. 60/477,974 Entitled "Electrically Small Planar Antennas With Inductively Coupled Feed" filed on Jun. 12, 2003.

STATEMENT REGARDING FEDERALLY SPONSORED RESEARCH OR DEVELOPMENT

This invention was made with Government support under Contract # N00014-01-1-0224, awarded by the U.S. Office of Naval Research. The Government has certain rights to this invention.

BACKGROUND OF THE INVENTION

1. Field of Invention

Embodiments disclosed herein generally relate to methods of designing antennas and antennas designed by those methods. In particular, embodiments relate to antennas with inductively coupled feed.

2. Description of Related Art

Electrically small antennas may include antennas with a size about 10% of the operating wavelength of the antenna or less (e.g., 5% of the operating wavelength). Existing designs for electrically small antennas typically have complicated structures. For example, Goubau (reference 6), Dobbins et al. (reference 7) and Foltz et al. (reference 8) each disclose relatively complex antenna designs. Complicated structures may make antenna fabrication difficult. Complicated structures may also be difficult to redesign to meet different operating frequencies. A concern with many electrically small antennas is that the input resistance of such antennas may be relatively small. The small input resistance may cause difficulty in matching the antenna to the associated radio frequency (RF) system. Certain known designs (e.g., see Altshuler (reference 1), Hansen et al. (reference 9) and Corum (reference 10)) utilize matching circuits to connect the antenna to the rest of the RF system. However, matching circuits may add to the size, loss, complexity and/or cost of the system.

SUMMARY

In an embodiment, an electrically small antenna may include at least one antenna winding and at least one antenna loop inductively coupled to at least one antenna winding. At least one antenna loop may be coupled to at least one antenna feed. In an embodiment, such antennas may have a characteristic radius less than about 5% of the operating wavelength of the antenna. Certain characteristics of antennas having inductively coupled feed may be modified by modifying the strength of the inductive coupling. For example, input resistance of the antenna, and/or bandwidth of the antenna may be modified by modifying the strength of the inductive coupling. In an embodiment, electrically small antennas having an inductively coupled feed may include planar features (e.g., features printed on substrate). In an embodiment, electrically small antennas having an inductively coupled feed may include two dimensional features (e.g., substantially coplanar wire structures). In an embodiment, electrically small antennas having an inductively coupled feed may include three dimensional features (e.g., substantially non-coplanar wire structures).

BRIEF DESCRIPTION OF THE DRAWINGS

Advantages of the present invention will become apparent to those skilled in the art with the benefit of the following detailed description of embodiment and upon reference to the accompanying drawings, in which:

FIG. 1 depicts an embodiment of a meander-winding antenna and numerical simulation results of the antenna's bandwidth as a function of antenna size;

FIG. 2 depicts an embodiment of a spiral-winding antenna and numerical simulation results of the antenna's bandwidth as a function of antenna size;

FIG. 3 depicts an embodiment of a particular inductively coupled monopole antenna design;

FIG. 4 depicts a plot of numerical and experimental return loss vs. frequency for the antenna in FIG. 3;

FIG. 5 depicts a plot of numerical and experimental efficiency vs. frequency for the antenna in FIG. 3;

FIG. 6 depicts an embodiment of a circuit model for the inductively coupled monopole antenna in FIG. 3; and FIG. 7 depicts a plot of input impedance using a circuit model and using NEC simulation.

While the invention is susceptible to various modifications and alternative forms, specific embodiments thereof are shown by way of example in the drawings and will herein be described in detail. It should be understood that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF EMBODIMENTS

The design of electrically small antennas may be challenging. For example, typically, as the size of an antenna is reduced, both its efficiency and bandwidth may decrease. Furthermore, the input resistance of an antenna may drop rapidly as the antenna's size is reduced, making impedance matching of the antenna to the rest of the RF system difficult. These issues may impact the overall system performance, especially in high data rate and/or low power consumption devices.

In an embodiment, relatively small monopole antennas (e.g., $kr<0.45$ Where $k=2\pi$(operating wavelength)) may include a point along the wire that is shorted to a ground plane. One interpretation of this feature may be that a first portion of the wire structure may act as an inductive feed. In such a case, the remaining portion may act as the radiating portion of the antenna. The radiating portion may carry most of the current. This inductive coupling mechanism may tend to increase the input resistance for electrically small antennas.

In certain embodiments, electrically small, two-dimensional, planar antenna geometries may be desired. For example, such antenna designs may include antennas having a meander-shaped winding or spiral-shaped winding. In an embodiment, the Numerical Electromagnetics Code (NEC) may be used to design and/or model the wire winding and feed configurations. For example, designs that consider bandwidth, efficiency and/or antenna size may be generated. Designs generated in this manner may compare favorably to known fundamental limits for small antennas.

Electrically small antennas generally refers to antennas having physical dimensions that are smaller than the antenna's operating wavelength (e.g., one tenth or less of the operating wavelength). Electrically small antennas are currently in demand in many wireless networking and communications applications. For example, in handheld devices or laptop computers, the available physical space for antennas may be very limited. Thus, electrically small antennas may be desirable for such applications. In addition to applications for personal communications systems (cell phones, personal digital assistants, laptops), electrically small antennas may be applied to HF communications and vehicular antennas. In HF communications (frequency range from 2 to 30 MHz), the typical size of antennas may be on the order of meters or tens of meters. Thus, electrically small antennas may be desirable. For vehicular applications, electrically small antennas designed by methods disclosed herein may be adaptable to design an on-glass antenna embedded in a windshield.

Embodiments disclosed herein include methods of designing electrically small antennas. In particular, methods may include planar antennas using inductively coupled feed structures. Such antennas may be electrically small and self-resonating. Additionally, such antennas may be capable of good efficiency and bandwidth characteristics without the need for an additional matching network. Inductively coupled feed may also be applied to other types of antenna structures. For example, three-dimensional antennas may be designed with an inductively coupled feed.

In an embodiment, an inductively coupled feed configuration may include a conductive loop in proximity to the antenna body. For example, a small rectangular loop may be located underneath the antenna body. One end of the loop may be used for the antenna feed. The other end of the loop may be shorted to a ground plane. The antenna body may include different types of windings. For example, antenna body 102 may include a meander winding 104, as shown in FIG. 1, a spiral winding 204, as shown in FIG. 2, etc. The strength of the inductive coupling may be controlled by the distance between feed 108 and antenna body 104, and/or the area of the rectangular loop 108. The resonant frequency of the antenna may be controlled by changing the width, height and/or number of wire turns of the antenna body 102. The size of the antenna may be defined in terms of a characteristic radius, r 110. For example, the radius 110 may be that of a circle that encloses the antenna structure. In an embodiment, a multi-objective Pareto GA may be employed to optimize the parameters in order to achieve a desirable bandwidth, relatively high efficiency and/or relatively small antenna size. In such embodiments, the design parameters may be encoded into a binary chromosome. The costs associated with the design goals may include:

$$\text{Cost1}=1-\text{Antenna Bandwidth/Theoretical Bandwidth Limit} \quad (1)$$

$$\text{Cost2}=1-\text{Efficiency}$$

$$\text{Cost3}=\text{Normalized Antenna Size (kr)}$$

The theoretical bandwidth limit in Cost1 may be defined as: $2/(1/kr+1/(kr)^3)$ as derived in reference [3]. The factor 2 in the theoretical bandwidth limit may account for the loaded-Q. After evaluating the three cost functions of each sample structure using NEC, all the samples of the population may be ranked using a non-dominated sorting method. Based on the rank, a reproduction process may be performed to refine the population into the next generation. In an embodiment, to inhibit the solutions from converging to a single point, a sharing scheme, as described in reference [4], may be used to generate a well-dispersed population. The final converged "Pareto front" may include optimized antenna designs that perform well in at least one out of the design goals (e.g., broad bandwidth, high efficiency or small antenna size).

FIG. 1 depicts simulation results of a converged Pareto front for a meander antenna structure. In FIG. 1, the designs are plotted in the bandwidth vs. antenna size space. The designs are also categorized according to their efficiencies. The $1/(1/kr+1/(kr)^3)$ limit 112 and $2/(1/kr+1/(kr)^3)$ limit 114 for small antennas are also plotted in FIG. 1 for reference. For the simulations, the antenna body and the feed were assumed to be copper wire with a conductivity of $5.7\times10^7$ s/m and a radius of 0.5 mm. The target design frequency was 400 MHz. An infinite ground plane was assumed in the numerical simulations. The design space was restricted to a two-dimensional plane. FIG. 1 shows that the resulting designs had similar performance compared to the 3-D arbitrary wire configurations reported in reference [2].

It is believed that to reduce the size of a meander-winding antenna below about kr=0.35 may be difficult. As a result, a spiral structure may be used. FIG. 2 depicts a spiral winding antenna design and numerically simulated bandwidth and efficiency of the spiral-winding antenna. FIG. 2 shows that the performance of the spiral winding antenna design was similar to that of the meander winding antenna design depicted in FIG. 1 for sizes kr>0.35. Additionally, the GA generated designs successfully for kr<0.35. Comparison of the total wire length for the meander winding and spiral winding structures showed that for a given wire spacing, the spiral structure required a smaller wire length compared to the corresponding meander structure.

To verify the numerical simulation results, three spiral-winding antennas were constructed based on the optimized designs. The three antennas built correspond to points A 206 (kr=0.23), B 208 (kr=0.36) and C 210 (kr=0.49) in FIG. 2. A 1.6 m×1.6 m conducting plate was used as the ground plane. The sizes of the three antennas were 2.8 cm, 4.3 cm and 5.9 cm, respectively. FIG. 3 depicts the antenna design 302 designated by point B 208 in the graph of FIG. 2. FIG. 4 depicts a plot of the resulting return loss of antenna 302 as a function of frequency from simulation and measurement. The simulated and measured results showed a similar bandwidth of about 1.77% from simulation and 1.95% from measurement (based on $|S_{11}|\leqq-3$ dB). There was a slight shift in the resonant frequency between the simulation and measured results due to the construction inaccuracy. FIG. 5 depicts the efficiency of antenna 302 from simulation and from the Wheeler cap measurement of the antenna. The measured efficiency of 84% was consistent with the simulation efficiency of 85% at the resonant frequency 502. Similar correlation was found for antennas A 206 and C 210.

The inductively coupled feed mechanism was investigated in more detail. FIG. 6 shows a proposed lumped-element circuit for an inductively coupled feed. The inductive coupling was modeled by a transformer. The antenna body and the antenna feed were simulated separately using NEC. The resulting data were fit to the circuit model to arrive at R, L and C values. The mutual inductance, M, between the feed loop and the antenna body was derived analytically. Using the completed circuit model, the input impedance curve (shown as dashed lines in FIG. 7) was determined. The solid lines in FIG. 7 show the simulated input impedance results for the entire antenna using NEC. From the circuit point of view, the transformer served to invert the small input resistance associated with the antenna body to achieve a proper step up.

Experiments were also conducted to explore the use of printed structures to implement the wire antenna designs. An inductively coupled antenna design was translated to printed lines on a 0.8 mm thick FR-4 substrate. Other than a frequency shift due to the FR-4 substrate, the antenna had very similar characteristics as the wire designs. It is therefore expected that 2-D wire designs determined by methods described herein may be convertible into planar (e.g., printed) antennas.

Thus using methods described in embodiments disclosed herein, inductively coupled antennas may be formed which include: (1) small size, (2) self-resonance, (3) broad bandwidth, (4) ease of design for various operating frequencies, and/or (5) simple fabrication. For example, the antenna's small size may be achieved through the use of a meander- or spiral-shaped antenna structures. Self-resonance may be achieved through the use of the inductive coupling to boost the antenna's input resistance. Additionally, the input resistance of antennas with inductively coupled feed may be adjusted by adjusting the strength of the inductive coupling. For example, the strength of the inductive coupling may be controlled by the distance between the feed and the antenna body and/or by the area of the inductive feed loop. Broad bandwidth may be achieved by fourth-order tuning about the resonant frequency. Design for different operating frequencies may be accomplished by varying the length of the antenna body. In such embodiments, fabrication may be simplified since the antenna structure may be completely planar. These antenna designs may also be fabricated using printed structures on dielectric substrates (e.g., FR-4 or Duroid) with minor scaling in size.

REFERENCES

The following references are incorporated herein by reference as through fully set forth herein:

[1] E. E. Altshuler, "Electrically small self-resonant wire antennas optimized using a genetic algorithm," *IEEE Trans. Antennas Propagat.,* vol. 50, pp. 297–300, March 2002.

[2] H. Choo, H. Ling and R. L. Rogers, "Design of electrically small wire antennas using genetic algorithm taking into consideration of bandwidth and efficiency," IEEE Antennas and Propagation Society International Symposium, pp. 330–333, San Antonio, Tex., June 2002.

[3] J. S. McLean, "A re-examination of the fundamental limits on the radiation Q of electrically small antennas," *IEEE Trans. Antennas Propagat.,* vol. 44, pp. 672–676, May 1996.

[4] J. Horn, N. Nafpliotis and D. E. Goldberg, "A niched pareto genetic algorithm for multiobjective optimization," *Proc. First IEEE Conf. Evolutionary Computation,* vol.1, pp. 82–87, 1994.

[5] E. H. Newman, P. Bohley, and C. H. Walter, "Two methods for the measurement of antenna efficiency," *IEEE Trans. Antennas Propagat.,* vol. 23, pp. 457–461, July 1975.

[6] G. Goubau, "Multi-element monopole antennas," in Proc. Workshop Electrically Small Antennas, ECOM, Ft. Monmouth, N.J., pp. 63–67, May 1976.

[7] J. A. Dobbins and R. L. Rogers, "Folded conical helix antenna," IEEE Trans. Antennas Propagat., vol. 49, pp. 1777–1781, December 2001.

[8] H. D. Foltz, J. S. McLean and G. Crook, "Disk-loaded monopoles with parallel strip elements," IEEE Trans. Antennas Propagat., vol. 46, pp. 1894–1896, December 1998.

[9] R. C. Hansen and R. D. Ridgley, "Fields of the Fields of the contrawound toroidal helix antenna," IEEE Trans. Antennas Propagat., vol. 49, pp. 1138–1141, August 2001.

[10] U.S. Pat. No. 4,622,558 entitled Toroidal Antenna" to J. F. Corum, issued, Nov. 11, 1986.

[11] J. M. Hendler, F. A. Asbury, F. M. Caimi, M. H. Thursby and K. L. Greer, "Fabrication method and apparatus for antenna structures in wireless communications devices," patent no. US 2002/0149521 A1, Oct. 17, 2002.

[12] F. M. Caimi and S. F. Sullivan, "Broadband antenna structures," U.S. Pat. No. 0,158,806 A1, Oct. 31, 2002.

[12] R. C. Fenwick, "A new class of electrically small antennas," IEEE Trans. Antennas Propagat., vol. 13, pp. 379–383, May 1965.

[13] Y. J. Guo and P. S. Excell, "On the resonant frequency of the normal mode helix antenna excited by a loop," IEE Colloquium on Electrically Small Antennas, pp. 1–3, London, October 1990.

[14] U.S. patent application Ser. No. 10/320,801, entitled "Microstrip Antennas and Methods of Designing Same" to Choo et al. filed Dec. 16, 2002.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description to the invention. Changes may be made in the elements described herein without departing from the spirit and scope o the invention as described in the following claims. In addition, it is to be understood that features described herein independently may, in certain embodiments, be combined.

What is claimed is:

1. An antenna, comprising:

a ground plane;

an antenna body formed by a winding, having two ends, wherein one of said two ends is connected to said ground plane; and an antenna feed having two ends, wherein one of said two ends is connected to said ground plane, wherein a length of said antenna feed is substantially shorter than a length of said antenna body, wherein said antenna feed is inductively coupled to said antenna body.

2. The antenna of claim 1, wherein said winding of said antenna body is a meander winding.

3. The antenna of claim 1, wherein said winding of said antenna body is a spiral winding.

4. The antenna of claim 1, wherein an input resistance of said antenna is controlled by a distance between said antenna body and said antenna feed.

5. The antenna of claim 1, wherein an operating frequency of said antenna is controlled by the length of said antenna body.

6. The antenna of claim 1, wherein an operating frequency of said antenna is controlled by the number of turns in said winding of said antenna body.

7. The antenna of claim 1, wherein said antenna body and said antenna feed are planar structures.

8. The antenna of claim 1, wherein said antenna body and said antenna feed are printed on a substrate.

9. The antenna of claim 1, wherein a second one of said two ends of said winding in said antenna body is open-ended.

10. The antenna of claim 1, wherein a second one of said two ends of said antenna feed is connected to an antenna input.

11. The antenna of claim 1, wherein a dimension of said antenna body is less than approximately 10% of an operating wavelength of said antenna.

12. The antenna of claim 1, wherein a dimension of said antenna body is less than approximately 4% of an operating wavelength of said antenna.

* * * * *